US008460062B2

(12) United States Patent
Schneider

(10) Patent No.: US 8,460,062 B2
(45) Date of Patent: Jun. 11, 2013

(54) POLISHING MACHINE FOR LENSES AND METHOD FOR POLISHING A LENS USING A MACHINE TOOL

(75) Inventor: Gunter Schneider, Marburg (DE)

(73) Assignee: Schneider GmbH & Co. KG, Fronhausen (DE)

( * ) Notice: Subject to any disclaimer, the term of this patent is extended or adjusted under 35 U.S.C. 154(b) by 580 days.

(21) Appl. No.: 12/733,602

(22) PCT Filed: Sep. 10, 2008

(86) PCT No.: PCT/EP2008/061989

§ 371 (c)(1),
(2), (4) Date: Jun. 14, 2010

(87) PCT Pub. No.: WO2009/034104

PCT Pub. Date: Mar. 19, 2009

(65) Prior Publication Data

US 2011/0009035 A1 Jan. 13, 2011

(30) Foreign Application Priority Data

Sep. 10, 2007 (DE) ..... 10 2007 042 667

(51) Int. Cl.
*B24B 1/00* (2006.01)

(52) U.S. Cl.
USPC ..... 451/42; 451/5; 451/44; 451/58; 451/65; 451/66; 451/277; 451/363

(58) Field of Classification Search
USPC ..... 451/5, 11, 42, 43, 44, 58, 65, 66, 451/277, 363, 362
See application file for complete search history.

(56) References Cited

U.S. PATENT DOCUMENTS

| | | | | |
|---|---|---|---|---|
| 5,220,749 | A * | 6/1993 | Youden et al. | 451/65 |
| 6,074,281 | A * | 6/2000 | Swanson et al. | 451/42 |
| 6,155,911 | A * | 12/2000 | Mandler | 451/42 |
| 6,336,057 | B1 * | 1/2002 | Obayashi | 700/164 |
| 6,383,061 | B1 * | 5/2002 | Mandler | 451/43 |
| 6,394,892 | B2 * | 5/2002 | Hanisch et al. | 451/259 |

(Continued)

FOREIGN PATENT DOCUMENTS

| | | |
|---|---|---|
| DE | 100 29 967 A1 | 1/2002 |
| DE | 101 06 659 A1 | 8/2002 |

(Continued)

*Primary Examiner* — George Nguyen
(74) *Attorney, Agent, or Firm* — Hudak, Shunk & Farine Co. LPA

(57) ABSTRACT

A polishing machine for lenses with at least one first polishing spindle having a polishing axis (K) and a tool holder disposed on the first polishing spindle for a first polishing disc designed as a tool, further comprising at least one first workpiece spindle having a rotary axis (C) and a workpiece holder disposed on the first workpiece spindle for a lens, wherein the workpiece holder and the tool holder are disposed so as to be movable in translation in the direction of a telescoping axis (Z) disposed parallel to the polishing axis (K) and in the direction of a translation axis (X) disposed at right angles to the rotary axis (C). The polishing machine further has at least one first tool changer for changing the tool and a working chamber formed of at least one wall spatially limiting a spray of polishing medium during processing, wherein at least the workpiece holder and the tool holder are disposed within the working chamber, wherein the first tool changer is disposed at least partially within the working chamber during operation.

20 Claims, 5 Drawing Sheets

U.S. PATENT DOCUMENTS

| | | | | |
|---|---|---|---|---|
| 6,497,482 | B1 * | 12/2002 | Matsuyama | 351/41 |
| 6,800,017 | B2 * | 10/2004 | Samukawa | 451/5 |
| 7,335,091 | B2 * | 2/2008 | Burgess | 451/273 |
| 7,422,510 | B2 * | 9/2008 | Schneider et al. | 451/5 |
| 7,455,569 | B2 * | 11/2008 | Schafer et al. | 451/11 |
| 8,083,572 | B2 * | 12/2011 | Nauche | 451/43 |
| 2001/0053659 | A1 * | 12/2001 | Shibata | 451/42 |
| 2004/0224619 | A1 * | 11/2004 | Granziera et al. | 451/277 |
| 2007/0049182 | A1 * | 3/2007 | Burgess | 451/51 |

FOREIGN PATENT DOCUMENTS

| | | | |
|---|---|---|---|
| DE | 102 48 104 | A1 | 5/2003 |
| DE | 10 2004 021721 | B3 | 10/2005 |
| DE | 10 2004 062 319 | | 3/2006 |
| EP | 1 867 430 | A1 | 12/2007 |

* cited by examiner

POLISHING MACHINE FOR LENSES AND METHOD FOR POLISHING A LENS USING A MACHINE TOOL

FIELD OF THE INVENTION

The invention relates to a polishing machine for lenses, comprising at least one first polishing spindle having a polishing axis K and a tool holder disposed on the first polishing spindle for a first polishing disc designed as a tool, further comprising at least one first workpiece spindle having a rotary axis C and a workpiece holder disposed on the first workpiece spindle, wherein the first workpiece spindle comprises a rotary axis C which can be aligned parallel to the polishing spindle, wherein the workpiece holder and the tool holder are disposed so as to be movable in translation in the direction of a telescoping axis Z disposed parallel to the polishing axis K and in the direction of a translation axis X disposed at right angles to the rotary axis C, further comprising at least one working chamber formed of at least one wall spatially limiting a spray of polishing medium during processing, wherein at least the workpiece holder and the tool holder are disposed or positioned within the working chamber, and a method for polishing a lens with a processing machine for lenses. The polishing disc is smaller than the lens, since it is a zonal tool which serves to polish partial areas of the lens.

BACKGROUND OF THE INVENTION

A processing machine for lenses is already known from DE 10 2004 021 721 B3. The processing machine comprises two workpiece spindles and two workpiece changers, wherein the respective workpiece spindle comprises a rotary axis and a pivot axis disposed at right-angles to the rotary axis. Two polishing units are provided adjacent to this, each with one polishing disc, which respectively comprise one bellows. The bellows has on its upper end an opening to retain the respective workpiece spindle, wherein the bellows provides a sealed closure after immersion of the workpiece spindle or workpiece drive into the polishing unit with the bellows. The respective bellows is open towards the base so that the polishing suspension can flow out.

Due to this sealed closure, the working chamber of the processing or polishing machine is limited in the sense of the definition of a working chamber according to the invention.

The tool changer is disposed outside of the working chamber in the section of the processing machine which is separated or sealed from the working chamber.

The separation of the working chamber described above from the rest of the machine is in particular of imminent significance with polishing machines, since the polishing emulsion forms a very hard and firm coating after drying, which when an insufficient seal is provided damages the gear elements which are contaminated by it. For this reason, the part of the machine which is exposed to the emulsion is spatially limited to a minimum.

DE 100 29 967 A1 describes a device for cutting optical components. The device comprises two side walls, within which an interim space extends which forms a processing area. Furthermore, a tool changer is provided which is disposed outside of the processing area. The tool changer is moved towards the processing area for the purpose of changing the tool, and the tool spindle is moved towards the tool changer. In all cases, cutting entails turning and milling and if necessary, also grinding. The use of a polishing medium or polishing emulsion is not possible or even advantageous with all of the cutting methods given above, since all join elements which are moistened with the polishing medium harden with time. At best, coolant is fed during cutting which serves to dispose of the material removed. Coolant has no setting properties.

DE 101 06 659 A1 describes a lens polishing machine. In order to limit the working chamber, a hood is provided which guarantees a separation of the working chamber on the other side. The hood is open downwards so that the polishing medium can flow out downwards into a shared vat which is provided for both hoods. Furthermore, it is described that for the purpose of changing the tool, the grabber rod is disposed in the area of an opening of the vat in such a manner that it can be moved diagonally, and can be moved into the working chamber thus formed from below through the open base of the hood. The tool changer is moved into the working chamber which is separated by the hood and is positioned outside of said working chamber during operation of the polishing machine. This is achieved in principle in order to prevent the tool changer from being contaminated by polishing suspension.

SUMMARY OF THE INVENTION

The object of the invention is to design and arrange a polishing machine for lenses and a method for polishing lenses in such a manner that a quick and efficient exchange of tools and workpieces is guaranteed despite the use of different tools.

The object is attained according to the invention by means of the fact that the first tool changer is also disposed or positioned at least partially within the working chamber during the operation of the polishing machine. Due to the working chamber, the spray of polishing medium is spatially limited. Accordingly, the tool changer which is located at least partially in the working chamber is moistened with the polishing medium during processing. With the disposal of the tool changer within the working chamber, said tool changer, together with the tool spindle which is to an extent with a fixed location, is freely accessible for the user. In contrast to the known limitation of the working chamber to the area directly located around the workpiece and the tool, the working chamber according to the invention is designed to be wider. This wider design enables the tool changer to be disposed within the working chamber, so that both the workpiece spindle with the workpiece and the polishing spindle and the tool changer can be simply operated manually directly in the working chamber. With the polishing machine known according to the prior art, the polishing spindles and the tool can only be grabbed mechanically via an additional tool changer. Since the tool spindle is disposed at a fixed location, all the essential transports axes which are necessary for the tool change lie on the side of the tool changer. These transport axes are reduced to a minimum in terms of type and quantity, so that on the one hand, the structure of the tool changer and on the other, a separation from the polishing medium, can be achieved in a simple manner.

The object is furthermore attained by means of the method according to the invention, namely that a polishing disc G is manually inserted into the polishing spindle, the lens is roughly zonally polished by means of the polishing disc G, the polishing disc G is removed by means of the tool changer from the polishing spindle, a polishing disc F is inserted into the polishing spindle by means of the tool changer, and the lens is finely zonally polished via the polishing spindle by means of the polishing disc F. The transportation movement for the tool change is conducted by the tool changer. The polishing spindle remains at a fixed location, and its only contribution to the tool change is a supporting axial movement in the direction of a telescoping axis Z.

According to the invention, at least one polishing disc, the polishing disc G, is manually changed or inserted for the rough processing. The polishing disc G is here selected according to the type and form of the lens to be polished. The polishing disc F which is used for the fine processing after the rough polishing is changed automatically according to the invention. While the polishing disc G for the rough processing is selected according to the form of the lens to be polished, the polishing disc F for the fine polishing processing for several lenses of different forms remains in the machine. The individual exchange of the polishing disc is therefore conducted only for the polishing disc G for the rough processing.

In this regard, it can also be advantageous that the first tool changer comprises a holding part with a left tool grabber, wherein the left tool grabber is also disposed or positioned at least partially within the working chamber during operation, and that the holding part comprises at least one further right-hand tool grabber, which is also disposed or positioned at least partially within the working chamber during operation. The tool changer is disposed together with its holding part and the two tool grabbers within the working chamber, so that said working chamber can be quickly and simply accessed manually directly after the polishing process has ended, or before the polishing process starts. Depending on the type of design of the tool changer, this is disposed not only partially, but also completely within the working chamber. With the partial disposal of the tool changer within the working chamber according to the invention, drive motors or drive gear elements for the tool changer or for the holding part are preferably disposed outside of the working chamber, and extend via corresponding sealing means into the working chamber through to the holding part or tool grabber.

Furthermore, it can be advantageous that the first tool changer comprises a pivot axis S which is disposed parallel to the polishing axis K, and that the tool changer (4) with the tool grabber, or at least the tool grabber, can be pivoted around the pivot axis S by an angle β1 at least between a parking position PP and a position PW1 in the area of the tool holder. The pivot axis S in itself is a simple machine axis, via which the tool grabber can be pivoted around the angle β1.

It can also be advantageous that the tool grabber can be pivoted around the pivot axis S, preferably in the opposite direction, by an angle β2 between the parking position PP and a position PW2 in the area of the tool holder. The tool grabber has a symmetrical structure and can as a supplement to the pivoting around the angle β1 described in a counter-clockwise direction, also be pivoted in a clockwise direction by the angle β2, so that by means of the one tool changer, both tools can be transported to the tool holder, or away from the tool holder. The transportation movement of the tool grabber is reduced to a minimum, since it is conducted essentially only around the pivot axis S, so that the respective holding part can be positioned. In addition, only two holding parts are provided. The transportation movement is now supplemented by an axial stroke movement in the direction of a stroke axis W. Thus, the tool grabber can be disposed within the working chamber, without an excessive extension of the working chamber being necessary.

Here, it can advantageously be provided that the first tool changer comprises a stroke axis W which is disposed parallel to the pivot axis S or parallel to the polishing axis K, and at least the holding part with the tool grabber can be moved in the direction of the stroke axis W at least between a position PA which holds the polishing disc and a position PF which releases the polishing disc from the tool holder. By means of the stroke axis W, which overlays the pivot axis S, the polishing disc can be placed onto the polishing holder, or removed from the tool holder, in a simple manner. This stroke movement is usually a vertical stroke or pivot movement. For this purpose, the tool grabber reaches into a circumferential groove provided on the polishing disc, so that it is connected in a form-fit manner to the polishing disc with regard to the stroke movement, and can pick up and set down the polishing disc against a locking force between the polishing disc and the tool holder.

It can be of particular importance to the present invention that the tool holder is supported via a ball joint in the area of a tipping angle α in such a manner that it can be tipped, and the tool holder can be moved via the telescoping axis Z at least between a position PO which releases the tipping movement by the tipping angle α and which guarantees the polishing process, and a position PB which at least partially limits the tipping movement by the tipping angle α. The support via the ball joint guarantees the relative movement between the polishing disc and the workpiece or lens surface required for polishing. In order to change the polishing disc, however, an essentially fixed position of the polishing disc is required. The position PB according to the invention guarantees sufficient limitation of the tipping angle, so that the polishing disc can be automatically grabbed or hooked via the tool grabber or holding part. The tipping movement of the polishing disc around the ball joint entails vertical movement portions of the polishing disc. In the position PB according to the invention, these vertical movement portions are no longer present due to the retracting telescoping movement of the stroke axis, so that as a result, the tipping angle α is limited accordingly.

In connection with the design and disposal according to the invention, it can be advantageous that in the position PB of the tool holder, the ball joint is limited with regard to the tipping angle α at least to a tipping angle or angle amount of maximum 5° or 10°. The reduction of the tipping angle according to the invention guarantees that the tool changer or respective tool grabber will reach into the groove of the polishing disc which is provided for the purpose.

It can furthermore be advantageous that the polishing spindle comprises a sleeve which can be driven in a rotary manner, which is rotatably supported in a housing around the polishing axis K, and that the tool holder is at least coupled via a bellows to the sleeve in such a manner that it is torsionally flexible, wherein the tool holder can be indirectly positioned in the position PB against the sleeve and/or the housing via the bellows in such a manner that the tipping angle α is at least partially limited or restricted. The bellows which is disposed on the sleeve, which connects the sleeve with the polishing disc, is according to the invention used as a support element for the polishing disc for the purpose of limiting its freedom with regard to the tipping angle α. In the position PB, the sleeve is withdrawn, so that the bellows is contracted or compressed accordingly, and in this respect only has a very low degree of elasticity. The sleeve or bellows with the reduced elasticity described above forms the stop or support element for the tool holder, so that said tool holder is limited in its freedom of movement to the above-mentioned value with regard to the tipping angle α. The remaining freedom of movement of the remaining tipping angle is guaranteed by the remaining elasticity of the bellows. This thus forms an elastic recovery element for the tool holder with regard to the remaining tipping angle α. The sleeve forms as it were the fixed full deflection which limits the remaining tipping angle α.

Additionally, it can be advantageous that the workpiece spindle is supported in such a manner that it can be pivoted around a pivot axis B which is disposed at right angles to the rotary axis C. The pivotability around the pivot axis B results in an overlaid pivot movement over the tipping movement of the polishing disc on the ball joint. The pivot axis B on the workpiece side is provided as a supplement depending on the size of the tipping movement by the polishing disc on the ball joint side.

Furthermore, it can be advantageous that at least one second workpiece spindle and one second polishing spindle are disposed with the same design and disposal as the first workpiece spindle and the polishing spindle in the working chamber. Furthermore, it can be advantageous that the second workpiece spindle and the second polishing spindle are disposed offset to the first workpiece spindle and the first polishing spindle in the direction of the translatory axis X. Due to the use of a second pair of spindles, the lenses can be processed in pairs. Here, it can be advantageous that a second tool changer is provided which is assigned to the second polishing spindle.

Ultimately, it can be advantageous that the working chamber is limited by a base wall, several side walls and a ceiling, wherein the workpiece spindle extends into the working chamber at least partially through a wall or an opening in the wall and/or through the ceiling or an opening in the ceiling. If the working chamber is cylindrical or oval in design, the side walls merge to form a cylinder wall. The same applies in the case of the spherical or partially spherical design for the ceiling and/or the base wall. According to the invention, the workpiece spindle does not extend completely into the working chamber, so that the sealing measures required to separate the spindle and above all the spindle drives in order to prevent contamination by polishing medium are restricted. The same applies for the respective polishing spindles and respective tool changers. At least the motor drives for the polishing spindles are disposed outside of the working chamber, so that these do not have to be sealed individually or separately against polishing medium.

For this purpose, it can also be advantageous that a flexibly designed sealing bush is provided on the workpiece spindle, and that the sealing bush is connected to the wall and/or the ceiling. During the polishing process, a partially rotary relative movement is required between the workpiece spindle and the polishing spindle. A rotary relative movement thus results between the workpiece spindle and the walls or ceiling of the working room which are in this regard disposed in a fixed manner. In order that on the one hand, the relative movement described above, and on the other, the sealing of the working chamber in the area of the passage for the workpiece spindle is guaranteed, a sealing bush according to the invention is preferably provided which is made of elastic material such as rubber.

It can also be advantageous that a guide track is provided via which at least a part of the wall and/or the ceiling is guided in such a manner that it can be displaced relative to the polishing axis K in a direction at right angles to the polishing axis K. In order to be able to guarantee greater traverse paths of the workpiece spindle relative to the working chamber or to its wall or ceiling, a part of the ceiling or wall is disposed in such a manner that it can be displaced via the guide track according to the invention. With a translatory movement of the workpiece spindle or a pivoting movement with a translatory portion, the corresponding part of the ceiling or wall is guided along the guide track, so that the movement portion remaining for the sealing bush is significantly reduced. Thus, the longevity of the sealing bush is guaranteed due to the large number of movement cycles.

It can also be advantageous that the wall and/or the ceiling is at least partially designed to be flexible or elastic. Alongside a displaceable disposal of the ceiling or wall in the area of the workpiece spindle, this can also be designed in an accordingly flexible manner in the form of a bellows, as well as being elastic, so that the relative movement between the workpiece spindle and the corresponding part of the ceiling or wall is guaranteed.

According to the method according to the invention, it can be provided that the polishing disc F is removed by means of the tool changer from the polishing spindle, and the polishing disc G is inserted into the polishing spindle by means of the tool changer.

The method according to the invention can further provide that the polishing disc G which is disposed in the polishing spindle is manually changed for the next lens to be polished, and that the lens is then polished in the manner according to the invention.

BRIEF DESCRIPTION OF THE DRAWINGS

Further advantages and details of the invention are explained in the patent claims and in the description, and are shown in the figures, in which:

DETAILED DESCRIPTION OF THE INVENTION

Figure 1:
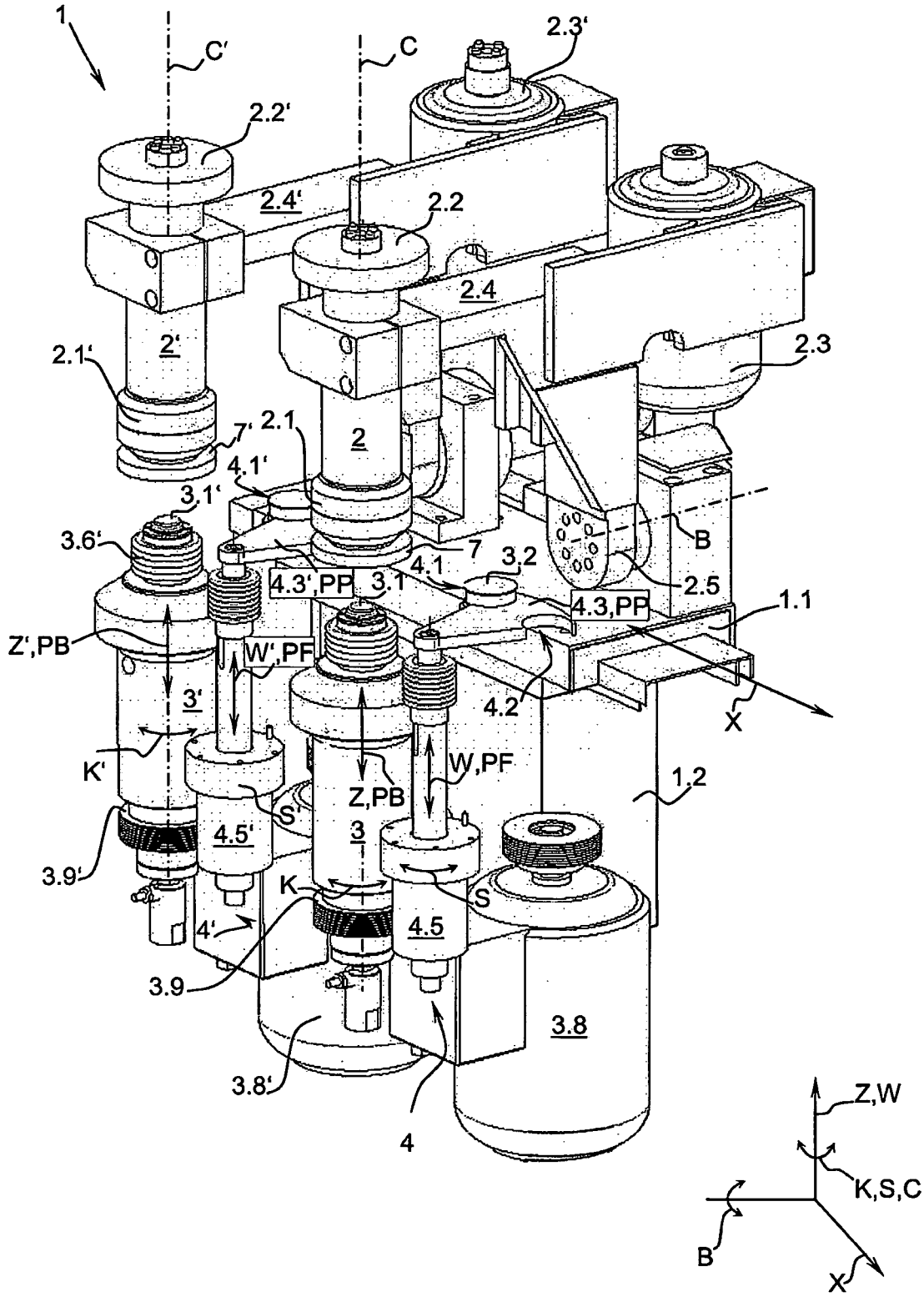
FIG. 1 shows a perspective view of a polishing machine.

A polishing machine 1 shown in FIG. 1 comprises two workpiece spindles 2, 2', which on their respective lower, front-side end comprise a workpiece holder 2.1, 2.1', which can be rotatably driven around a rotary axis C, C'. On the respective polishing spindle 2, 2', a workpiece or a lens 7, 7' is disposed via the workpiece holder 2.1, 2.1'. The respective workpiece spindle 2, 2' comprises opposite to the workpiece holder 2.1, 2.1' a drive wheel 2.2, 2.2', which can be connected to a respective drive motor 2.3, 2.3' via traction means, not shown. The respective spindle 2, 2' and the respective motor 2.3, 2.3' are coupled or firmly disposed on it via a spindle frame 2.4, 2.4'. The respective spindle frame 2.4, 2.4' is disposed via a pivot bearing 2.5 in such a manner that it can be pivoted around a pivot axis B on a slide 1.1 of the polishing machine 1. The slide 1.1 can be moved to the left and right in a translatory movement in the direction of a translatory axis X which runs at right angles to the pivot axis B. The slide 1.1 sits on a base 1.2 of the polishing machine 1.

Additionally, two polishing spindles 3, 3' with the associated motors 3.8, 3.8' and two tool changers 4, 4' are provided. Both the polishing spindles 3, 3' and their motors 3.8, 3.8' and the two tool changers 4, 4' are disposed on the base 1.2 of the polishing machine 1.

The polishing spindle 3, 3' is disposed at a fixed location or stationary and comprises on its upper front side a tool holder 3.1, 3.1' which can be adjusted over a telescoping axis Z in the vertical direction parallel to the respective rotary axis C, C' of the workpiece spindle 2, 2'. Furthermore, the respective polishing spindle 3, 3' comprises a polishing axis K, K' around which the tool holder 3.1, 3.1' can be rotated. On the side opposite the tool holder 3.1, 3.1', a drive wheel 3.9, 3.9' is provided which can be connected to the motor 3.8, 3.8' via traction means, not shown.

The tool holder 3.1, 3.1' is connected via a stroke piston or piston 3.7*a* and a bellows 3.6, 3.6' to a polishing sleeve 3.4, 3.4' according to FIG. 5. The bellows 3.6, 3.6' is the jointed and torsionally flexible connection between the sleeve 3.4 and the tool holder 3.1, 3.1'.

The respective tool changer 4, 4' comprises one stroke axis W, W' and one pivot axis S, S' respectively. On the upper front side, the tool changer 4, 4' comprises a holding part 4.3, 4.3' which comprises a left-hand and a right-hand tool grabber 4.1, 4.2. The holding part 4.3, 4.3' can be pivoted around the pivot axis S in both a clockwise and a counter-clockwise direction according to FIG. 3*b* and FIG. 4. Alongside, the holding part 4.3, 4.3' can be adjusted via the stroke axis W in the vertical direction relative to the polishing spindle 3, 3' or relative to the tool holder 3.1, 3.1'.

Figure 2:
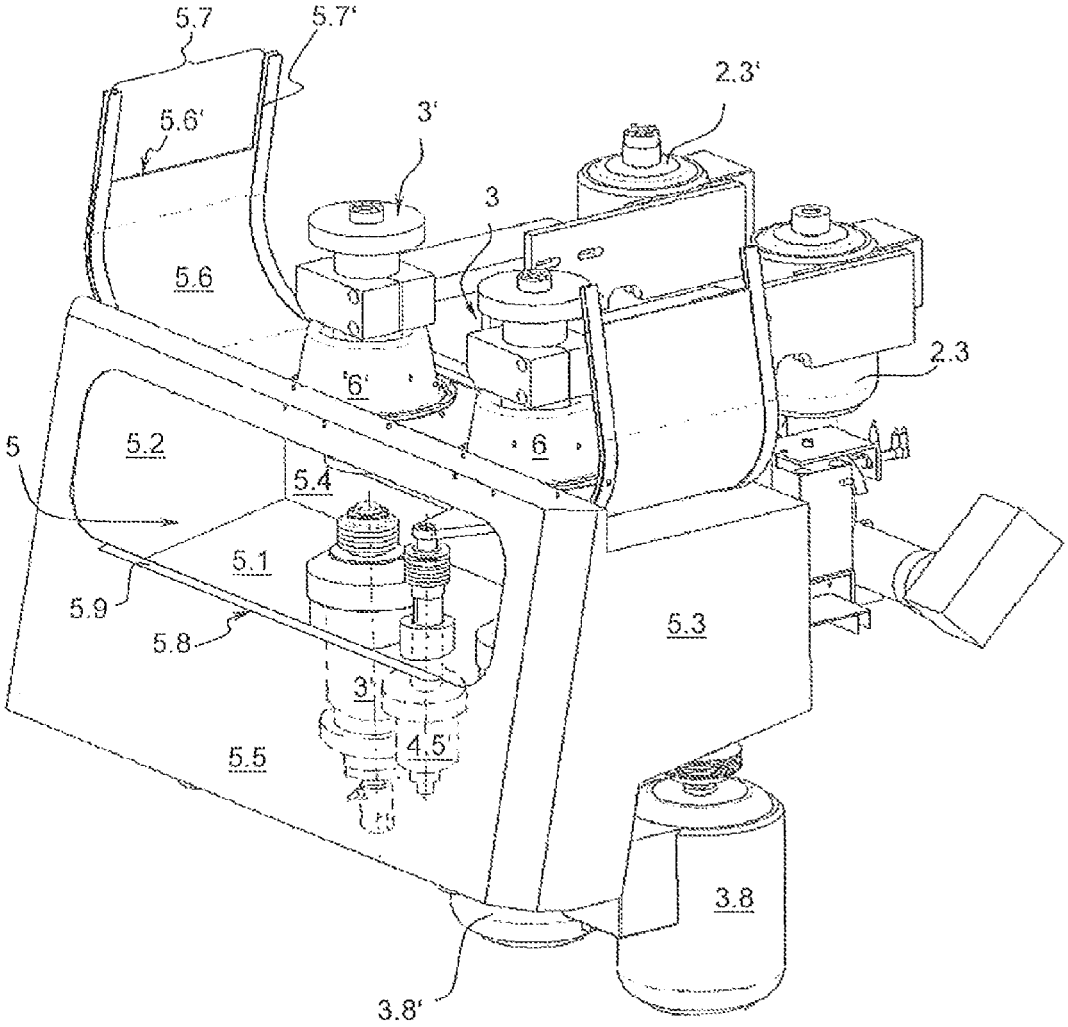
FIG. 2 shows a perspective view of the polishing machine with working chamber.

In FIG. 2, the essential part of a working chamber 5 or the side walls 5.2-5.5 which form the working chamber, and a base wall 5.1 and a ceiling 5.6 are shown. The front side wall 5.5 comprises an access opening 5.8 which can be closed via a flap 5.9 which can be pivoted inwards. The ceiling 5.6 or the ceiling element can be moved to the left or right within a guide track 5.7, so that with a translatory traverse displacement of the respective spindle 3, 3', the ceiling 5.6 can also move to the left and right with a translatory movement according to the degree of freedom within the guide track. The respective spindle 3, 3' is connected via a flexible sealing bush 6, 6' to the ceiling element 5.6 in such a manner that a seal is formed. The sealing bush 6, 6' is here elastic or flexible, so that the respective spindle 3, 3' can in particular conduct pivoting movements, i.e. rotary movement portions, relative to the ceiling element 5.6. The guide track 5.7 is in the area above the working chamber 5 designed to be straight, and extends upwards at both ends of the working chamber 5 in the area of the respective side wall 5.2, 5.3 in a curved form, so that when the ceiling element 5.6 is moved to the right or left, a movement of the respective front side 5.6' of the ceiling element 5.6 is conducted upwards or downwards within end sections 5.7' of the guide track 5.7 which are disposed approximately vertically. The working chamber 5 comprises within the base wall 5.1 an outflow, not shown, for polishing medium. Polishing medium is sprayed within the working chamber 5 during processing.

Figure 3A:
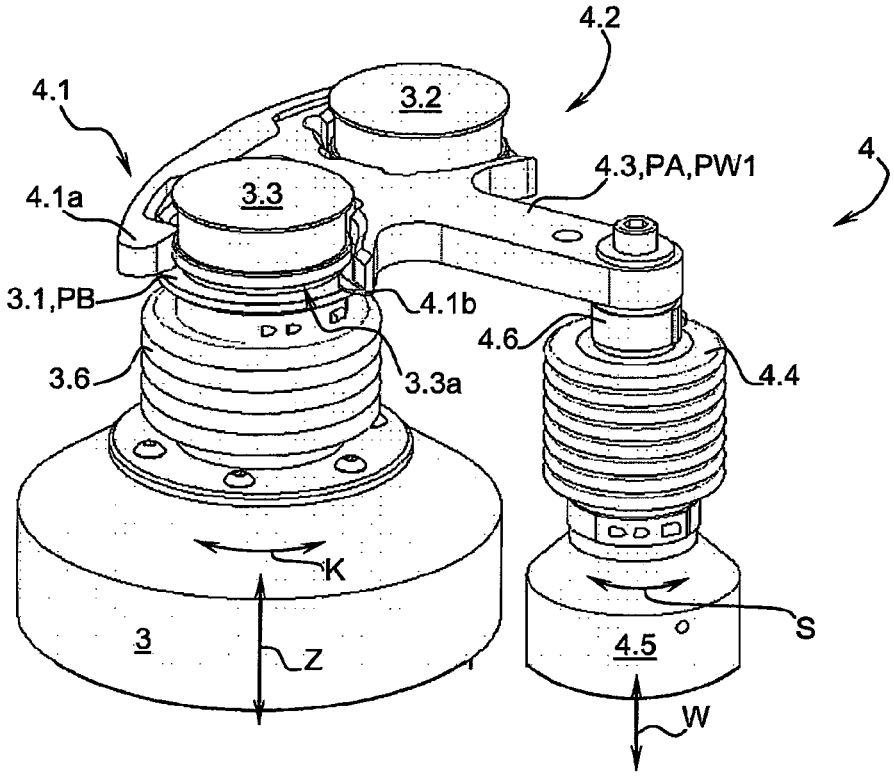
FIG. 3*a* shows a perspective view of a polishing spindle and the tool changer.

FIG. 3*a* shows the polishing spindle 3 and the first tool changer 4 with the holding part 4.3 in the position PW1, PA. The tool changer 4 comprises a pivot device 4.5, 4.5' in the manner of a pivot spindle with limited pivot angle, on the upper end of which a bellows 4.4 is provided which is actively connected to a pivot shaft 4.6. The pivot shaft 4.6 can be pivoted around the pivot axis S between a parking position PP and the two positions PW1, PW2 on the tool, and can be vertically moved in the direction of the stroke axis W between the holding position PA and the released position PF. Via the pivot shaft 4.6, the holding part 4.3 with the left-hand tool grabber 4.1 directly engages with a polishing disc 3.2 which is located on the tool holder 3.1 of the polishing spindle 3. The holding part 4.3 is here located in the change position PW1, i.e. the first change position on the polishing spindle 3 and at the same time in the position PA, i.e. in the lower position for holding a polishing disc 3.3. Accordingly, the tool holder 3.1 is located in its position PB which is lower with regard to a telescoping axis Z and which blocks the pivot movement of the tool holder 3.1.

Figure 6:
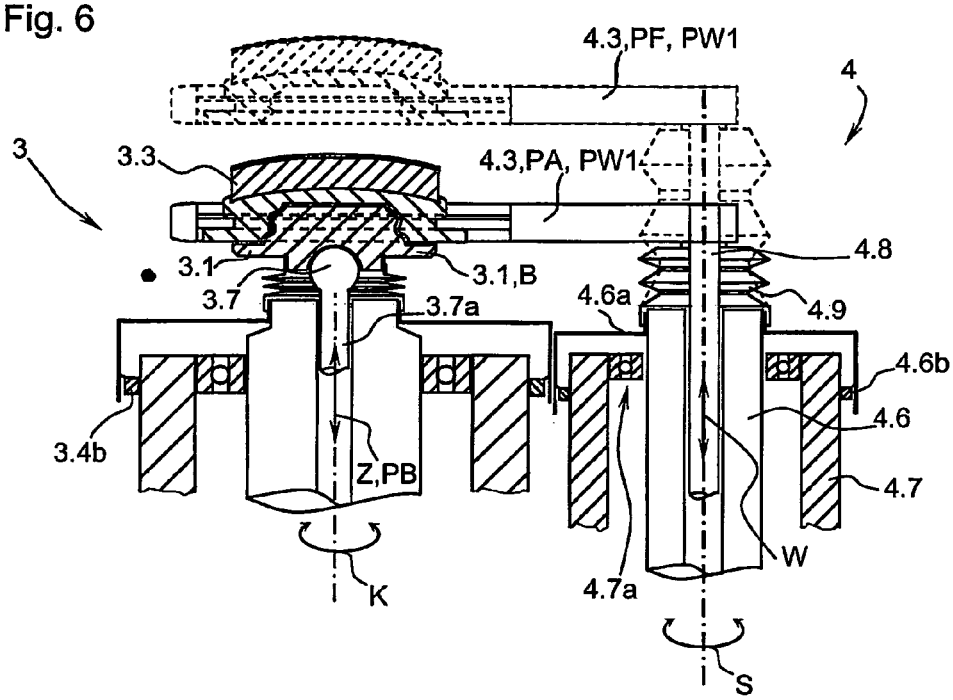
FIG. 6 shows the sketch of the polishing spindle with the tool changer in its positions PF and PA.

On the basis of the position PA shown in FIG. 3*a*, the holding part 4.3 according to the drawing shown in FIG. 6 lifts the polishing disc 3.3 by means of the tool grabber 4.1 which is engaged, and thus releases it from the tool holder. On the basis of this position PF, PW1, the holding part 4.3 then pivots around the pivot axis S into the parking position PP shown in FIG. 1.

Figure 3B:
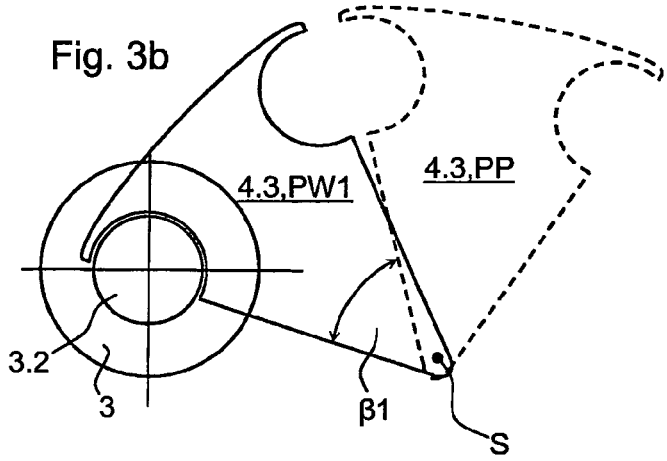
FIG. 3*b* shows a sketch of the two positions of the workpiece changer.

FIG. 3*b* shows the position according to FIG. 3*a* as a schematic diagram in a view from above. The holding part 4.3 pivots between the change position PW1 of the left-hand tool grabber 4.1 in the area of the polishing spindle 3 by the angle β1 into the parking position PP as shown by a broken line, and which can also be seen in FIG. 1. The left-hand tool grabber 4.1 comprises an outer holding projection 4.1*a* which can be elastically re-formed relative to the holding part 4.3, so that when the tool grabber 4.1 swings inwards, an elastic or pre-tensioned grabbing of the polishing disc 3.2 is guaranteed. The same applies to the right-hand tool grabber 4.2.

Figure 4A:
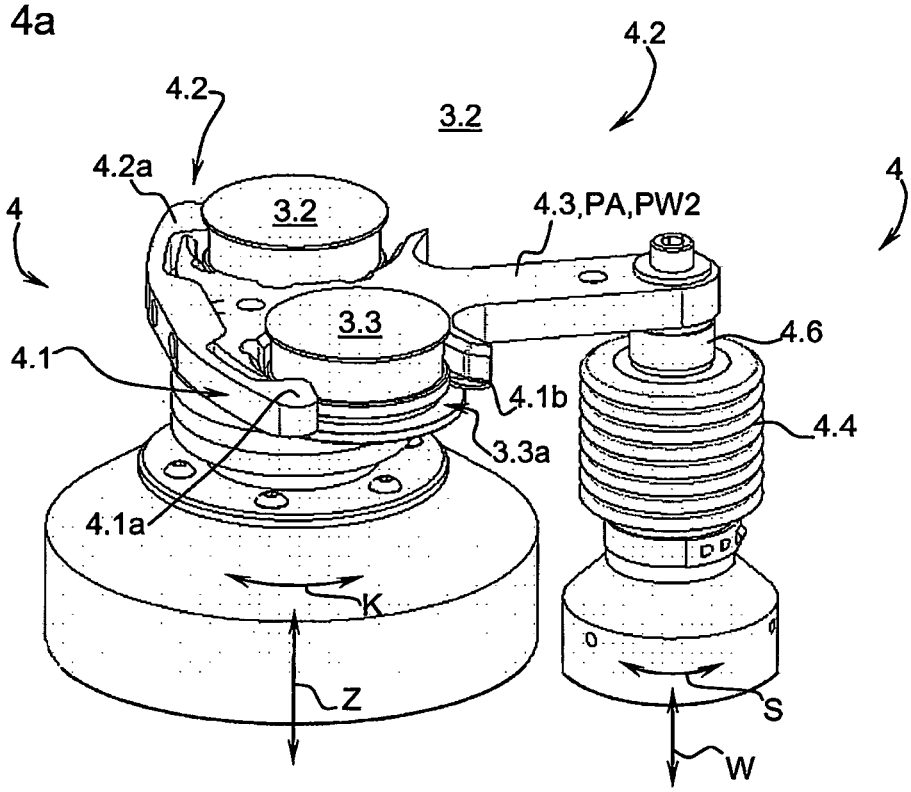
FIG. 4*a* shows a view according to FIG. 3*a* in the other position of the tool changer.

In this respect, FIG. 4*a* corresponds to FIG. 3*a*, wherein the holding part 4.3 is located in the change position PW2, so that the right-hand tool grabber 4.2 is positioned directly on the polishing spindle 3 in the holding position PA. The right-hand tool grabber 4.2 grabs onto the polishing disc 3.2, or grabs it from the rear with a holding projection 4.2*a*.

In order to lift the respective polishing disc 3.3 in an axial direction, the respective tool grabber 4.1 comprises an edge 4.1*b* which comes to rest in a holding groove 3.3*a* of the respective polishing disc 3.3, so that in relation to the axial lifting or axial movement, a form fit connection results between the respective tool grabber 4.1 or its holding projection 4.1*a* and the polishing disc 3.3 or its holding groove 3.3*a*.

Figure 5A:
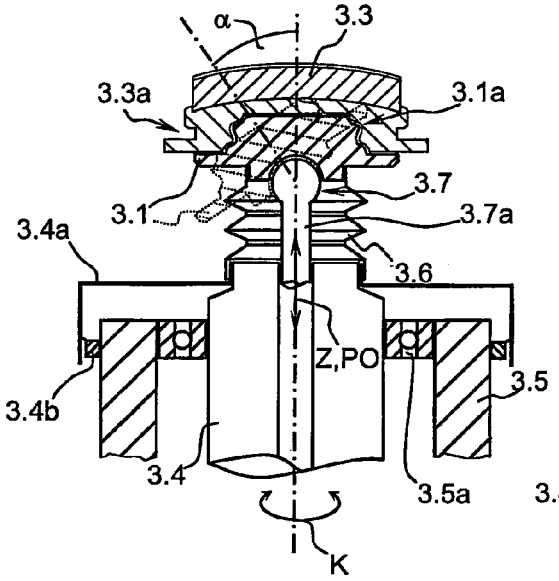
FIG. 5*a* shows the sketch of the polishing spindle with the tool holder and the polishing disc in position PO.

FIG. 5*a* shows as a schematic diagram in profile the polishing spindle 3 with a ball joint 3.7 which can be moved along the telescoping axis Z and around the polishing axis K. On the ball joint 3.7, the tool holder 3.1 sits in a jointed manner. The torsionally flexible connection between the sleeve 3.4 and the tool holder 3.1 is guaranteed by the bellows 3.6. The polishing disc 3.3 is clipped onto the tool holder 3.1 from above via corresponding latch elements 3.1*a* of the tool holder 3.1. The tool holder 3.1 with the polishing disc 3.3 can be freely tipped or pivoted via the ball joint 3.7 within the range of the tipping angle α, as is shown by a broken line.

The ball joint 3.7 is disposed on the front side of a stroke piston or piston 3.7*a*, wherein the piston 3.7*a* can be axially adjusted within the sleeve 3.4 in the direction of the telescoping axis Z. This axial adjustment movement overlays a rotational movement of the sleeve 3.4 within a housing 3.5. For this purpose, the sleeve 3.4 is rotatably supported via bearings 3.5*a* within the housing 3.5. The sleeve 3.4 is sealed on the front side by a housing part 3.4*a*. The housing part 3.4*a* comprises a circumferential sealing element 3.4*b* for this purpose.

Figure 5B:
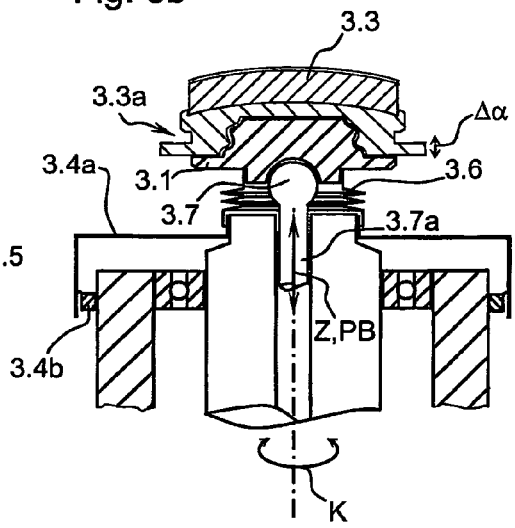
FIG. 5*b* shows the sketch according to FIG. 5*a* with the tool holder in position PB.

In FIG. 5*b*, the piston 3.7*a* and the ball joint 3.7 or the tool holder 3.1 are in the position PB which blocks the tipping angle α. The bellows 3.6 is here contracted, so that its elasticity is significantly reduced. Since the tool holder 3.1 is directly connected to the bellows 3.6 to form a seal and in a torsionally flexible manner, the freedom of movement of the tool holder 3.1 in relation to the ball joint 3.7 and the tipping angle α is limited to a minimum due to the now contracted and in this regard still limited elastic bellows 3.6. The bellows 3.6 forms an elastic recovery element with regard to the neutral or horizontal position of the tool holder 3.1 or tipping angle αdue to its reduced elasticity, while the sleeve 3.4 forms the full deflection.

In FIG. 6, the tool changer 4 is shown as a schematic diagram in addition to the polishing spindle 3. The holding part 4.3 is here located in the position PA which takes the polishing disc 3.3 from the tool holder 3.1, i.e. it is moved vertically downwards in one direction. The tool grabber 4.1 is here engaged via its holding projection 4.1*a* and the edge 4.1*b* as shown in FIG. 4*a* with the polishing disc 3.3 or its holding groove 3.3*a*.

Figure 4B:
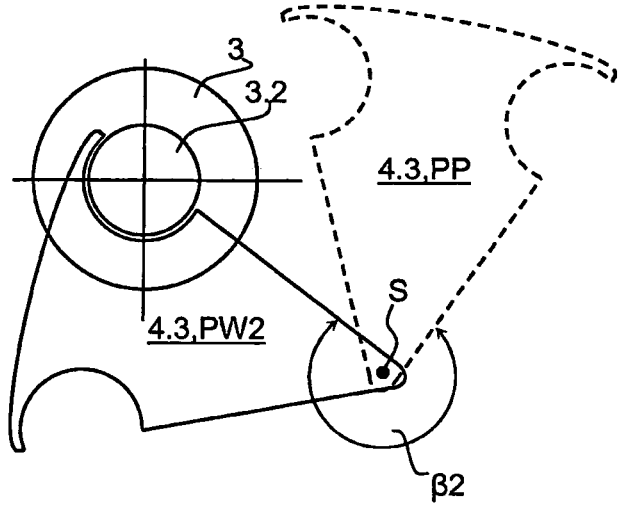
FIG. 4*b* shows the sketch of the two positions of the tool changer.

The tool changer 4 comprises the pivot shaft 4.6, which is supported within a housing 4.7 by bearings 4.7*a* in such a manner that it can be rotated around the pivot axis S. Within the pivot shaft 4.6, a stroke piston or piston 4.8 is disposed in a torque-proof manner and in such a manner that it can be moved in a translatory manner in the direction of the stroke axis W. The stroke movement of the holding part 4.3 between the position PA which holds the polishing disc 3.3 of the polishing spindle 3 and the position PF (shown as a broken line) which releases the polishing disc 3.3 is here conducted using the piston 4.8. The pivot movement between the parking position PP and the respective change position PW1, PW2 according to FIG. 3*b* and FIG. 4*b* is here conducted using the pivot shaft 4.6. The piston 4.8 and the pivot shaft 4.6 are here sealed via a bellows 4.9 against the pivot shaft 4.6. The engagement or hooking movement of the tool grabber 4.1 into the holding groove 3.3*a* by means of the holding projection 4.1*a* is conducted by the pivot movement of the pivot shaft 4.6 from position PP into position PW1 or PW2 around the pivot axis S.

The sleeve 3.4 of the polishing spindle 3 is sealed by the housing part 3.4*a* against the polishing spindle housing 3.5. The same applies to the pivot shaft 4.6 of the tool changer 4. This is sealed by a housing part 4.6*a* against the changer housing 4.7. The housing part 4.6*a* comprises a circumferential sealing element 4.6*b* for this purpose.

The axial movement of the polishing spindle 3 is conducted in the direction of the telescoping axis Z by the piston 3.7*a*, while the rotational movement is conducted by the sleeve 3.4.

LIST OF REFERENCE NUMERALS

1 Polishing machine
1.1 Slide
1.2 Base
2 First workpiece spindle
2' Second workpiece spindle
2.1 Workpiece holder
2.1' Workpiece holder
2.2 Drive wheel
2.2' Drive wheel
2.3 Motor
2.3' Motor
2.4 Spindle frame
2.4' Spindle frame
2.5 Pivot bearing
3 First polishing spindle
3' Second polishing spindle
3.1 Tool holder
3.1' Tool holder
3.1*a* Latch element
3.2 Polishing disc, polishing disc G
3.3 Polishing disc, polishing disc F
3.3*a* Holding groove
3.4 Sleeve
3.4' Sleeve
3.4*a* Housing part
3.4*b* Sealing element
3.5 Housing
3.5*a* Bearing
3.6 Bellows
3.6' Bellows
3.7 Ball joint
3.7*a* Piston, stroke piston
3.8 Motor
3.8' Motor
3.9 Drive wheel
3.9' Drive wheel
4 First tool changer
4' Second tool changer
4.1 Left-hand tool grabber
4.1' Left-hand tool grabber
4.1*a* Holding projection
4.1*b* Edge
4.2 Right-hand tool grabber
4.2*a* Holding projection
4.3 Holding part
4.3' Holding part
4.4 Bellows
4.5 Pivot device
4.5' Pivot device
4.6 Pivot shaft
4.6*a* Housing part
4.6*b* Sealing element
4.7 Housing
4.7*a* Bearing
4.8 Piston, stroke piston
4.9 Bellows
5 Working chamber
5.1 Base wall
5.2 Side wall
5.3 Side wall
5.4 Side wall
5.5 Side wall
5.6 Ceiling, ceiling element, wall
5.6' Ceiling, ceiling element, wall
5.7 Guide track
5.7' Guide track
5.8 Access opening
5.9 Flap
6 Sealing bush
6' Sealing bush
7 Workpiece, lens
7' Workpiece, lens
B Pivot axis
C Rotary axis
C' Rotary axis
K Polishing axis
K' Polishing axis
PA Position
PB Position
PF Position
PO Position
PP Parking position
PW1 Change position
PW2 Change position
S Pivot axis
S' Pivot axis
W Stroke axis
W' Stroke axis
X Translatory axis
Z Telescoping axis
Z' Telescoping axis α Tipping angle
β1 Angle
β2 Angle

The invention claimed is:

1. A polishing machine for lenses comprising: at least one first polishing spindle having a polishing axis K and a tool holder disposed on the first polishing spindle for a first polishing disc designed as a tool, further comprising at least one first workpiece spindle having a rotary axis C and a workpiece holder disposed on the first workpiece spindle for a lens, wherein the workpiece holder and the tool holder are disposed so as to be movable in translation in the direction of a telescoping axis Z disposed parallel to the polishing axis and in the direction of a translation axis disposed at right angles to the rotary axis, further comprising at least one first tool changer for changing the tool, further comprising a working chamber formed of at least one wall spatially limiting a spray of polishing medium during processing, wherein at least the workpiece holder and the tool holder are disposed within the working chamber, wherein the first tool changer is disposed at least partially outside of the working chamber.

2. The polishing machine according to claim 1,
wherein the first tool changer comprises a holding part with a left-hand tool grabber, wherein the left-hand tool grabber is disposed at least partially within the working chamber.

3. The polishing machine according to claim 2, wherein the holding part comprises at least one further right-hand tool grabber which is disposed at least partially within the working chamber.

4. The polishing machine according to claim 3, wherein the first tool changer comprises a pivot axis S which is disposed parallel to the polishing axis K and the tool changer with the left-hand tool grabber can be pivoted around the pivot axis S by an angle β1 at least between a parking position PP and a position PW1 in the area of the tool holder.

5. The polishing machine according to claim 4, wherein the right-hand tool grabber can be pivoted around the pivot axis S by an angle β2 between the parking position PP and a position PW2 in the area of the tool holder.

6. The polishing machine according to claim 4, wherein the first tool changer comprises a stroke axis W which is disposed parallel to the pivot axis S or parallel to the polishing axis K, and can be moved in the direction of a stroke axis W at least between a position PA which holds the polishing disc and a position PF which releases the polishing disc from the tool holder.

7. The polishing machine according to claim 1, wherein the tool holder is supported via a ball joint in the area of a tipping angle α in such a manner that it can be tipped, and the tool holder can be moved via the telescoping axis Z at least between a position PO which guarantees the tipping movement by the tipping angle α and the polishing process, and a position PB which at least partially limits the tipping movement by the tipping angle α.

8. The polishing machine according to, claim 7, wherein in a position PB of the tool holder, the ball joint is limited with regard to the tipping angle α at least to a maximum tipping angle of 5° or 10°.

9. The polishing machine according to claim 8, wherein the first polishing spindle comprises a sleeve which can be driven in a rotary manner, which is rotatably supported in a housing around the polishing axis K, and that the tool holder is coupled via a bellows to the sleeve, wherein the tool holder can be indirectly positioned in the position PB via the bellows or directly positioned against the sleeve and/or the housing in such a manner that the tipping angle α is at least partially limited.

10. The polishing machine according to claim 1, wherein the first workpiece spindle is supported in such a manner that it can be pivoted around a pivot axis B which is disposed at right-angles to the rotary axis C.

11. The polishing machine according to claim 1, wherein at least one second workpiece spindle and one second polishing spindle are disposed with the same design and disposal as the first workpiece spindle and the first polishing spindle in the working chamber.

12. The polishing machine according to claim 11, wherein the second workpiece spindle and the second polishing spindle are offset in the direction of a translatory axis X to the first workpiece spindle and the first polishing spindle.

13. The polishing machine according to claim 11, wherein a second tool changer is provided which is assigned to the second polishing spindle.

14. The polishing machine according to claim 1, wherein the working chamber is limited by a base wall, several side walls and a ceiling, wherein the workpiece spindle extends at least partially into the working chamber.

15. The polishing machine according to claim 14, wherein between the workpiece spindle and the wall and/or the ceiling, a flexibly designed sealing bush is provided.

16. The polishing machine according to claim 14, wherein a guide track is provided via which at least a part of the wall and/or the ceiling is guided in such a manner that it can be displaced relative to the polishing axis K in a direction at right-angles to the polishing axis K.

17. The polishing machine according to claim 14, wherein the wall and/or the ceiling is designed to be at least partially flexible or elastic.

18. A method for polishing a lens with a processing machine for lenses comprising the steps of:
a) manually inserting a polishing disc G into a polishing spindle,
b) roughly polishing the lens via the polishing spindle by means of a polishing disc G,
c) removing the polishing disc G by means of a tool changer from the polishing spindle,
d) inserting a polishing disc F by means of the tool changer into the polishing spindle, and
e) finely polishing the lens via the polishing spindle using the polishing disc F.

19. The method according to claim 18, further including the steps of:
a) removing the polishing disc F by means of the tool changer from the polishing spindle, and
b) inserting the polishing disc G by means of the tool changer into the polishing spindle.

20. The method according to claim 19, wherein
a) the polishing disc G which is disposed in the polishing spindle is manually changed for the next lens to be polished,
b) the lens is changed, and then
c) the lens is polished.

* * * * *